United States Patent [19]

Parraud et al.

[11] Patent Number: 4,973,798

[45] Date of Patent: Nov. 27, 1990

[54] RIGID ELECTRICAL INSULATOR

[75] Inventors: René Parraud, Puy Guillaume; Guy Thevenet, Randan, both of France

[73] Assignee: Societe Anonyme dite: Sediver Societe Europeenne D'Isolateurs En Verre Et Composite, Courbevoie, France

[21] Appl. No.: 444,205

[22] Filed: Dec. 1, 1989

[51] Int. Cl.[5] ..... H01B 17/14

[52] U.S. Cl. ..... 174/176; 174/158 R; 174/179; 174/194; 174/209

[58] Field of Search ..... 174/137 A, 137 B, 158 R, 174/165, 174, 176, 177, 178, 179, 194, 195, 209, 210

[56] References Cited

U.S. PATENT DOCUMENTS

| | | | |
|---|---|---|---|
| 2,317,799 | 4/1943 | Pereles | 174/210 |
| 3,586,758 | 6/1971 | Harmon | 174/158 R |

FOREIGN PATENT DOCUMENTS

| | | | |
|---|---|---|---|
| 239985 | 8/1962 | Australia | 174/194 |
| 1156130 | 10/1963 | Fed. Rep. of Germany | 174/209 |
| 2046774 | 3/1972 | Fed. Rep. of Germany | 174/158 R |
| 589349 | 1/1978 | U.S.S.R. | 174/209 |
| 1048434 | 11/1966 | United Kingdom | 174/209 |

*Primary Examiner*—Laramie E. Askin

*Attorney, Agent, or Firm*—Sughrue, Mion, Zinn, Macpeak & Seas

[57] ABSTRACT

A rigid electrical insulator of the type having a base or a pin at its bottom and having at least one groove (18 or 19) for receiving an electrical cable at its top, the insulator being characterized by the fact that it includes at least one central rod (1) fixed at its bottom end to the base (5) or to the pin and at its top end to a rigid head (7) provided with at least one channel (8 or 9), the outside faces of the rod and of the rigid head (7) being covered in waterproof manner by a covering (10), with the head covering being of a flexible elastomer and the rod covering being selected from elastomers, resins, and varnishes, the groove (18 or 19) being defined by the channel (8 or 9) covered by its covering.

11 Claims, 2 Drawing Sheets

RIGID ELECTRICAL INSULATOR

The present invention relates to a rigid electrical insulator.

Two types of rigid insulator are known: a rigid insulator having a pin and satisfying the standard ANSI C29-6-1984, and a rigid insulator having a base in accordance with the standard ANSI C29-7-1983, or IEC 720.

Such an insulator includes at least one dielectric made of porcelain, glass, or cycloaliphatic resin, having its bottom end carried by a metal base or pin, and having a head with a groove for receiving an electric cable directly. The groove may be situated on the side face and/or the top face of the head. The electric cable is held therein by means of binding. The dimensions of grooves and the shapes of bindings are standardized.

It is observed that when conventional insulators are subjected to acts of vandalism, there is a danger of the dielectric breaking completely and thereby allowing the cable to fall. Insufficient bending strength is sometimes also observed, as is a degree of erosion of the cable in its zone which is in contact with the groove in the insulator, and this may give rise to cable breakage.

The object of the present invention is to provide a type of rigid electrical insulator capable of mitigating these drawbacks.

The present invention provides a rigid electrical insulator of the type having a base or a pin, at its bottom and having at least one groove for receiving an electric cable at its top, the insulator being characterized by the fact that it includes at least one central rod fixed at its bottom end to said base or to said pin and at its top end to a rigid head provided with at least one channel, the outside faces of said rod and of said rigid head being covered in waterproof manner by a covering, with the head covering being of a flexible elastomer and the rod covering being selected from elastomers, resins, and varnishes, said groove being defined by said channel covered by its covering.

The outside surface of said rod is preferably cylindrical or frustoconical.

The rod may be solid or hollow. Its end which is connected to said rigid head may advantageously be provided with notching or with appropriate machining.

The rigid head is made of a material selected from thermoplastic materials (polyester, polyamide, polyacetal, . . . ) or thermosetting materials (epoxy, polyurethane, . . . ), ceramics, glass, porcelain, and metals. For electrical reasons it is preferable to use an insulating material The insulating material may have a filler of mineral powder, or of fibers which are insulating or semiconducting.

The rigid head may be molded onto the corresponding end of the rod, or it may be fixed by gluing, or by any other appropriate means.

The flexible elastomer covering said rigid head is selected from vulcanizable elastomers (EPDM, silicone, . . . ) and thermoplastic elastomers. The material covering the rod may be selected from the preceding elastomers, varnishes, epoxy resins, and polyesters, which may optionally include a filler. This covering may be smooth or it may include fins of various shapes.

A composite rigid insulator of the invention is usable over a range of voltages lying between 5 kV and 100 kV, and it has numerous advantages. Thus, it withstands bending forces better than prior rigid insulators. In the event of severe bending corresponding to a load greater than the standardized value, a clean break that could give rise to the cable falling is not observed. The insulator of the invention is much better at withstanding shocks due to vandalism: here again the risk of a clean break is limited In addition, the cable is received in a groove constituted by a channel provided in the rigid head and lined with elastomer Even if it is subjected to vibration, the cable rests on a flexible cushion which prevents the strands of the cable suffering abrasion The insulator of the invention is lighter and less bulky than prior rigid insulators having equivalent insulating properties. It is also observed that its level of radio interference is very low.

Other characteristics and advantages of the present invention appear from the following description of embodiments given by way of non-limiting example. In the accompanying drawings:

FIG. 1 shows a composite rigid insulator of the invention comparable with a ceramic rigid insulator of class 57.3 in the ANSI standard.

Figure 1:
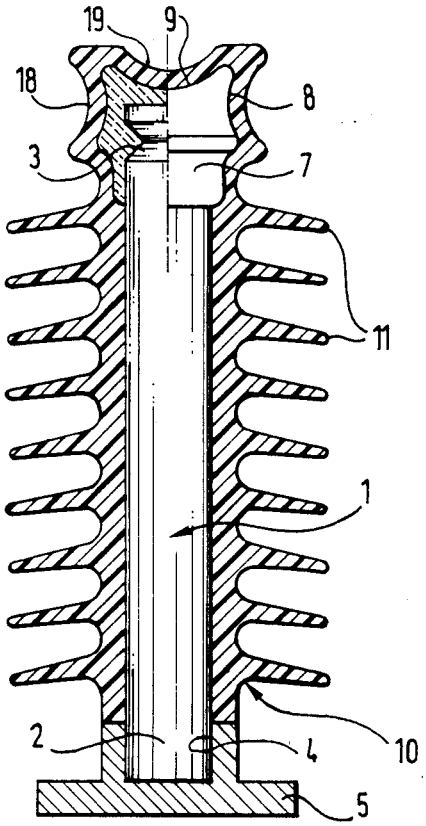
FIG. 1 is a diagrammatic view of a composite rigid insulator of the invention shown in partial longitudinal section.

This insulator comprises a central rod 1 made of glass fibers bonded together by a resin, with one end 2 being fixed in a housing 4 in a base-forming metal fitting 5. Its other end 3 is provided with at least one notch and is bonded, e.g. by overmolding, to a rigid head 7 made of thermosetting resin. (The notches may be replaced by any other machining.)

The head 7 has a side channel 8 and a top channel 9. The outside face of the rigid head 7, of the rod 1, and of a portion of the fitting 5 has an elastomer covering 10 overmolded thereon. At the head 7, this covering defines a top groove 19 overlying the channel 9 and a side groove 18 overlying the channel 8. These two grooves of standardized dimensions are intended to receive a cable.

The covering 10 shown includes fins 11 which may be of various profiles and various diameters.

The maximum diameter of the insulator of the invention lies between 45 mm and 65 mm, whereas the diameter of a corresponding porcelain insulator lies between 85 mm and 130 mm.

The weight of an insulator of the invention is about three times smaller than the weight of a directly comparable porcelain insulator.

As for bending strength, the insulator of FIG. 1 has been mounted in a test machine for observing load and corresponding deflection. The ANSI standard requires a bending strength of 2800 lbs. At this value, the observed deflection is 28 mm, whereas for a porcelain insulator it is a few millimeters. With a porcelain insulator, this value is very close to the deflection which causes the head of the insulator to break, whereas with an insulator of the invention, breaking occurs only when the deflection is about 50 mm, corresponding to a load of 4300 lbs.

The cable received in the groove 19 on the groove 18 in which it is fixed by a standardized binding rests on a cushion of flexible elastomer which does not run the risk of damaging it in the long run.

If the insulator receives bullet impacts, the shock cannot cause the entire structure to break or shatter, as happens with porcelain insulators.

FIGS. 2 to 11 show variant embodiments for various components of the FIG. 1 insulator.

Figure 2:
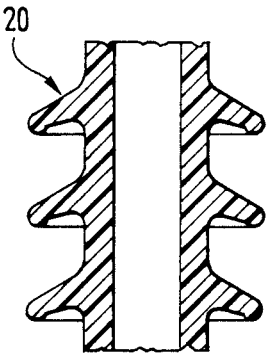
FIGS. 2 to 4 are fragmentary diagrammatic sections through three variants of the covering of an insulator of the invention.
Figure 3:
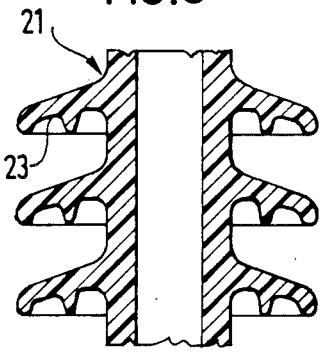
Figure 4:
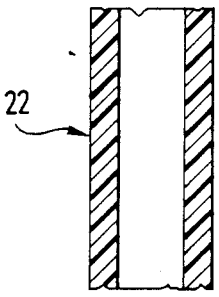

FIGS. 2, 3, and 4 show various coverings for the rod 1. Elastomer covering 20 (FIG. 2) is provided with fins which are all of the same configuration. The fins of elastomer covering 21 (FIG. 3) include ribs 23 on their underside. The covering 22 (FIG. 4) is a tubular sheath made of a varnish type of material.

Figure 5:
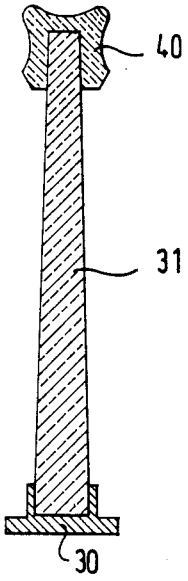
FIGS. 5 to 9 are diagrammatic longitudinal section views through uncovered insulators of the invention showing various types of rod.

In FIG. 5, the rod 31 is in the form of a truncated cone whose ends are fixed respectively in a metal base end fitting 30 and to an insulating rigid head 40.

Figure 6:
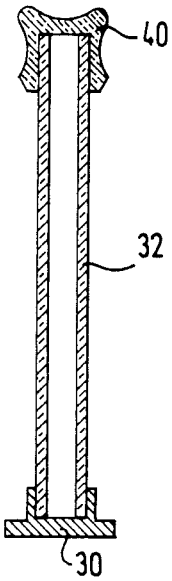
Figure 7:
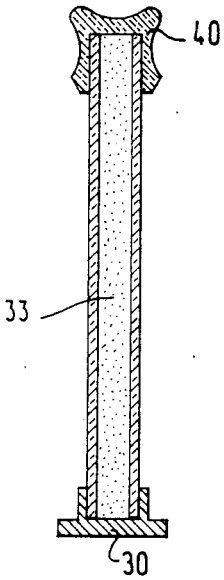

In FIG. 6, the rod 32 is a hollow cylinder which may optionally be filled with an insulating resin or foam 33 (FIG. 7).

Figure 8:
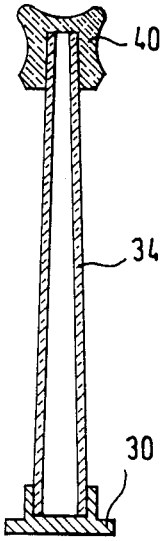
Figure 9:
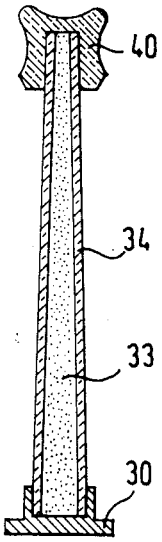

In FIG. 8, the rod 34 is a hollow truncated cone, which may likewise optionally be filled with an insulating resin or foam 33 (FIG. 9).

Figure 10:
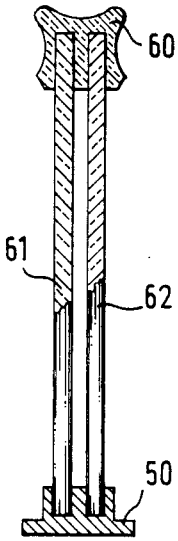
FIG. 10 is a diagrammatic section view through an uncovered insulator of the invention including a plurality of rods.

In FIG. 10, the insulator has two rods 61 and 62 fixed in parallel with each other to a metal base end fitting 50 and to an insulating rigid head 60. In another variant, there may be more than two such rods.

Figure 11:
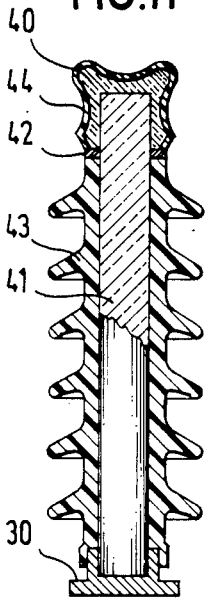
FIG. 11 is a diagrammatic section view through another variant insulator of the invention.

In FIG. 11, a metal ring 42 constituting a metal connection piece is fixed around the rod 41 beneath the head 40. As in the preceding variants, the exposed faces of the rod and of the head 40 are provided with waterproof coverings 43 and 44 which may be made of different materials. The join between these two coverings may be provided by the metal part.

Naturally the invention is not limited to the embodiments described above.

The invention is also applicable to rigid insulators having a pin which is fixed in the central rod.

The above description refers to a head of insulating material. It is also possible to use a metal head.

The material covering the rigid head is selected so as to be as flexible as possible.

When the insulator has a plurality of rods, they need not necessarily be disposed parallel to one another.

We claim:

1. A rigid electrical insulator of the type having a base or a pin, at its bottom and having at least one groove for receiving an electric cable at its top, the insulator being characterized by the fact that it includes at least one central rod fixed at its bottom end to said base or to said pin and at its top end to a rigid head provided with at least one channel, the outside faces of said rod and of said rigid head being covered in waterproof manner by a covering, with the head covering being of a flexible elastomer and the rod covering being selected from elastomers, resins, and varnishes, said groove being defined by said channel covered by its covering.

2. A rigid electrical insulator according to claim 1, characterized by the fact that the outside surface of said rod is cylindrical.

3. A rigid electrical insulator according to claim 1, characterized by the fact that the outside surface of said rod is a truncated cone.

4. A rigid electrical insulator according to claim 1, characterized by the fact that said rod is hollow.

5. A rigid electrical insulator according to claim 4, characterized by the fact that the internal cavity of said rod is filled with an insulating resin or foam.

6. A rigid electrical insulator according to claim 1, characterized by the fact that the end of said rod which is connected to said rigid head has at least one notch.

7. A rigid electrical insulator according to claim 1, characterized by the fact that said rigid head is made of a material selected from: thermoplastic materials, thermosetting materials, metals, ceramics, glass, and porcelain.

8. A rigid electrical insulator according to claim 7, characterized by the fact that said material of said rigid head includes a filler constituted by mineral powder, or by fibers which are insulating or semiconducting.

9. A rigid electrical insulator according to claim 1, characterized by the fact that the rod covering material is selected from: vulcanizable elastomers, thermoplastics, varnishes, epoxy resins, and polyesters, optionally including a filler.

10. A rigid electrical insulator according to claim 1, characterized by the fact that the flexible material of the covering on said rigid head is selected from vulcanizable elastomers and thermoplastics.

11. A rigid electrical insulator according to claim 1 characterized by the fact that it includes a plurality of rods disposed in parallel with each other.

* * * * *